US010677463B2

(12) United States Patent
Mery et al.

(10) Patent No.: US 10,677,463 B2
(45) Date of Patent: Jun. 9, 2020

(54) AIR INTAKE RING FOR A TURBOMACHINE COMBUSTION CHAMBER INJECTION SYSTEM AND METHOD OF ATOMIZING FUEL IN AN INJECTION SYSTEM COMPRISING SAID AIR INTAKE RING

(71) Applicant: SAFRAN AIRCRAFT ENGINES, Paris (FR)

(72) Inventors: Yoann Mery, Paris (FR); Alain Rene Cayre, Pamfou (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 349 days.

(21) Appl. No.: 15/529,570

(22) PCT Filed: Dec. 2, 2015

(86) PCT No.: PCT/FR2015/053296
§ 371 (c)(1),
(2) Date: May 25, 2017

(87) PCT Pub. No.: WO2016/087780
PCT Pub. Date: Jun. 9, 2016

(65) Prior Publication Data

US 2017/0363290 A1 Dec. 21, 2017

(30) Foreign Application Priority Data

Dec. 3, 2014 (FR) ..... 14 61862

(51) Int. Cl.
*F23R 3/10* (2006.01)
*F23R 3/28* (2006.01)
(Continued)

(52) U.S. Cl.
CPC ..... *F23R 3/10* (2013.01); *F23R 3/14* (2013.01); *F23R 3/28* (2013.01); *F23R 3/286* (2013.01); *F23R 3/42* (2013.01)

(58) Field of Classification Search
CPC .. F23R 3/14; F23R 3/286; F23R 3/343; F23C 2900/07001
See application file for complete search history.

(56) References Cited

U.S. PATENT DOCUMENTS 5,417,070 A 5/1995 Richardson
6,314,739 B1 11/2001 Howell et al.
(Continued)

FOREIGN PATENT DOCUMENTS

WO 2010/081940 A1 7/2010

OTHER PUBLICATIONS

International Search Report dated Feb. 10, 2016 in PCT/FR2015/053296 filed Dec. 2, 2015.
(Continued)

*Primary Examiner* — Gerald L Sung
*Assistant Examiner* — Colin J Paulauskas
(74) *Attorney, Agent, or Firm* — Oblon, McClelland, Maier & Neustadt, L.L.P.

(57) ABSTRACT

A system for improving fuel-air mixing inside an injection system of a turbomachine combustion chamber. An air intake ring has an annular deflection wall, or venturi, having an internal profile provided with a discontinuity inducing an increase in the radius (φ) of the internal profile downstream of the discontinuity. A method of atomizing fuel includes separating fuel trickling over the internal profile of the annular deflection wall from the internal profile at the level of the discontinuity so as to form droplets within a flow of air coming from an upstream air circulation space of the air intake ring.

7 Claims, 4 Drawing Sheets

(51) Int. Cl.
*F23R 3/14* (2006.01)
*F23R 3/42* (2006.01)

(56) References Cited

U.S. PATENT DOCUMENTS

| | | | | |
|---|---|---|---|---|
| 2003/0010034 | A1 | 1/2003 | Baudoin et al. | |
| 2005/0097889 | A1* | 5/2005 | Pilatis | F23D 11/107 60/743 |
| 2005/0229600 | A1 | 10/2005 | Kastrup et al. | |
| 2008/0302105 | A1* | 12/2008 | Oda | F23R 3/28 60/737 |
| 2011/0271682 | A1* | 11/2011 | Sandelis | F23C 7/004 60/737 |

OTHER PUBLICATIONS

French Search Report dated Oct. 6, 2015 in FR 1461862 filed Dec. 3, 2014.
U.S. Appl. No. 14/950,518, filed Nov. 24, 2015, US 2016/0153662 A1, Alain Cayre et al.
U.S. Pat. No. 7,805,943 B2, Oct. 5, 2010, Michel Andre Albert Desaulty et al.

* cited by examiner

AIR INTAKE RING FOR A TURBOMACHINE COMBUSTION CHAMBER INJECTION SYSTEM AND METHOD OF ATOMIZING FUEL IN AN INJECTION SYSTEM COMPRISING SAID AIR INTAKE RING

TECHNICAL FIELD

This invention relates to the field of turbomachines for aircraft and more particularly relates to an air intake ring intended to form a portion of an air and fuel injection system in a combustion chamber within a turbomachine.

PRIOR ART

FIG. 1 appended hereto illustrates a turbomachine 10 for an aircraft of a known type, for example a dual-flow turboreactor, comprising in a general manner a fan 12 intended to aspirate an air flow divided downstream of the fan into a primary flow supplying a core of the turbomachine and a secondary flow bypassing said core. The core of the turbomachine comprises, in a general manner, a low-pressure compressor 14, a high-pressure compressor 16, a combustion chamber 18, a high-pressure turbine 20 and a low-pressure turbine 22. The turbomachine is ducted by a nacelle 24 surrounding the flow space 26 of the secondary flow. The rotors of the turbomachine are mounted such that they rotate about a longitudinal axis 28 of the turbomachine.

FIG. 2 shows the combustion chamber 18 of the turbomachine in FIG. 1. In a conventional manner, said combustion chamber, which is of annular type, comprises two coaxial annular walls that are radially internal 32 and radially external 34 respectively, and that extend in an upstream to downstream direction, according to the direction 36 of flow of the primary gas flow in the turbomachine, about the axis of the combustion chamber which corresponds to the axis 28 of the turbomachine. These internal 32 and external 34 annular walls are connected to each other at their upstream end by a chamber annular end wall 40 that extends substantially radially about the axis 28. Said chamber annular end wall 40 is equipped with injection systems 42 distributed about the axis 28 to allow for the injection of an air and fuel pre-mixture centred along an injection axis 44.

During operation, a portion 46 of an air flow 48 originating from the compressor 16 supplies the injection systems 42, whereas another portion 50 of this air flow bypasses the combustion chamber, flowing in a downstream direction along the coaxial walls 32 and 34 of said chamber, and in particular allows air orifices made within said walls 32 and 34 to be supplied.

FIG. 3 is an axial half-sectional view of one of the injection systems 42. It comprises, in a general manner, a head 52 of a fuel injector, a bushing 54, sometimes called a "sliding bushing", in which the head 52 of the injector is mounted, an air intake ring 56, and a bowl 58, sometimes called a "mixing bowl". Said elements are centred relative to the injection axis 44 defined by the head 52 of the fuel injector.

The air intake ring 56 has a shape such that it generally revolves about the injection axis 44, said axis thus constituting an axis of revolution for the air intake ring 56.

The air intake ring 56 comprises an annular separation wall 60 that divides the air intake ring into an upstream air circulation space 62 and a downstream air circulation space 64. Said two spaces are often called "swirlers".

The annular separation wall 60 extends radially inwards into an annular deflection wall 66, often called a "venturi", having an internal profile 68 that is convergent-divergent in shape, having in particular a neck 70, in addition to an external profile 72.

Each of the upstream 62 and downstream 64 air circulation spaces are passed through by fins 74 allowing for the gyration of the air about the axis of revolution 44 of the air intake ring.

During operation, a portion of the air 46 supplying the injection system penetrates the air circulation spaces 62 and 64 of the air intake ring 56 and continues its path in the form of air flows 76 and 78 along the internal 68 and external 72 profiles of the annular deflection wall 66.

Moreover, fuel is ejected by the head 52 of the injector, in the form of a cone 80 with an angle θ relative to the injection axis 44.

A large portion of said fuel is deposited and forms a film 82 on the internal profile 68 of the annular deflection wall 66.

Driven by the air flow circulating in a downstream direction along said internal profile 68, the fuel trickles in a downstream direction over the internal profile 68.

Having arrived at the downstream end of the internal profile 68, the fuel meets the air flow 78 circulating along the external profile 72 of the annular deflection wall 66. Said air flow 78 induces a shearing effect which results in the fuel separating from the annular deflection wall so as to form droplets suspended in the air.

It should be noted that the portion of the internal profile 68 covered by the fuel film 82 thus forms an annular region 83 that extends as far as the downstream end of the internal profile 68.

The fuel droplets separated from the annular deflection wall are intended to evaporate into the air, preferably before reaching the interior of the combustion chamber.

The evaporation of the droplets is favoured, as far as possible, by the turbulence induced by the encounter of the air flows 76 and 78 respectively circulating on either side of the annular deflection wall.

This type of injection system is not however optimal as the fuel droplets formed at the downstream end of the annular deflection wall are relatively large in size, and benefit from a relatively limited volume in which to evaporate.

For this reason, the combustion efficiency remains limited.

DESCRIPTION OF THE INVENTION

The purpose of the invention is in particular to provide a simple, low-cost and effective solution to this problem.

To that end, it proposes an air intake ring for a turbomachine combustion chamber injection system, having an axis of revolution, and comprising an annular separation wall that divides the air intake ring into an upstream air circulation space and a downstream air circulation space, and that extends radially inwards into an annular deflection wall having an internal profile with a convergent-divergent shape.

According to the invention, the internal profile of the annular deflection wall is provided with a discontinuity that induces an increase in the radius of the internal profile downstream of said discontinuity.

The discontinuity induces the presence of an edge at the level of the downstream end of an upstream portion of the internal profile.

The fuel tricking over the internal profile therefore tends to separate at the level of this edge, driven to such by the air flow circulating along the internal profile, originating from the upstream air circulation space.

The separation of the fuel into droplets therefore takes place further upstream than with the known types of air intake ring.

The droplets therefore have a larger volume for evaporation before penetrating the combustion chamber.

Moreover, the discontinuity creates a recirculation area downstream thereof and induces turbulence, which favours the mixing of the fuel with the air, and which also enables thickening of the flame front.

In a general manner, the invention therefore allows the combustion efficiency to be improved.

Preferably, the discontinuity is formed at the level of a neck of the internal profile of the annular deflection wall.

Furthermore, said discontinuity preferably defines a shoulder extending orthogonally to said axis of revolution of the air intake ring.

In one preferred embodiment of the invention, each of the upstream and downstream air circulation spaces are passed through by fins allowing for the gyration of the air about said axis of revolution of the air intake ring.

The invention further relates to an injection system for a turbomachine combustion chamber, comprising a fuel injector head, in addition to an air intake ring of the type described hereinabove, wherein the fuel injector head is configured to spray fuel over an annular region of the internal profile of the annular deflection wall, and wherein the discontinuity is formed downstream of an upstream end of said annular region of the internal profile.

The invention further relates to a combustion chamber for a turbomachine, comprising at least one injection system of the type described hereinabove.

The invention further relates to a turbomachine, in particular for an aircraft, comprising at least one combustion chamber of the type described hereinabove.

Finally, the invention relates to a method of atomising fuel in an injection system of the type described hereinabove, with which a turbomachine combustion chamber is equipped, wherein fuel originating from the injector head trickles over the internal profile of the annular deflection wall, and separates from said internal profile at the level of the discontinuity of the latter, so as to form droplets within a flow of air coming from the upstream air circulation space of the air intake ring and circulating along the internal profile of the annular deflection wall.

BRIEF DESCRIPTION OF THE FIGURES

The invention will be better understood, and other features, advantages and characteristics of the invention will appear upon reading the following description provided as a non-limiting example with reference to the appended figures, in which.

In all of these figures, identical references may represent identical or similar elements.

DETAILED DESCRIPTION OF A PREFERRED EMBODIMENT

Figure 1:
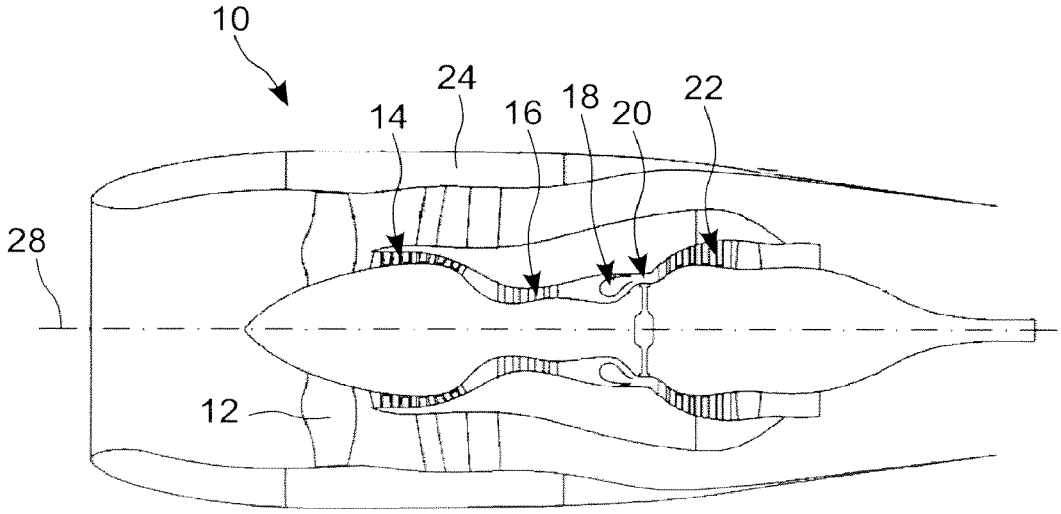
FIG. 1, previously described, is a partial diagrammatic view of an axial cross-section of a known type of turbomachine.
Figure 2:
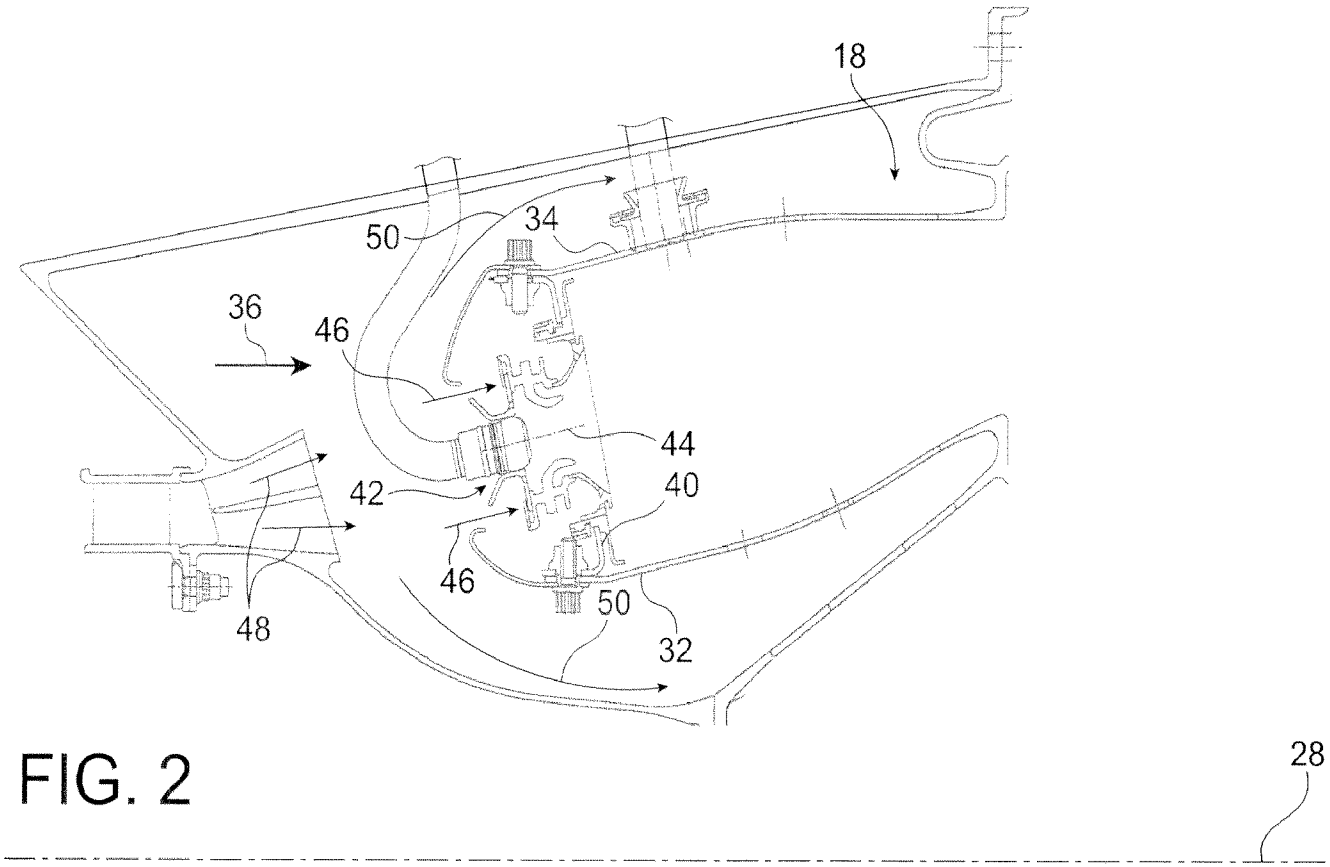
FIG. 2, previously described, is a partial diagrammatic view of an axial cross-section of a combustion chamber of the turbomachine in FIG. 1.
Figure 3:
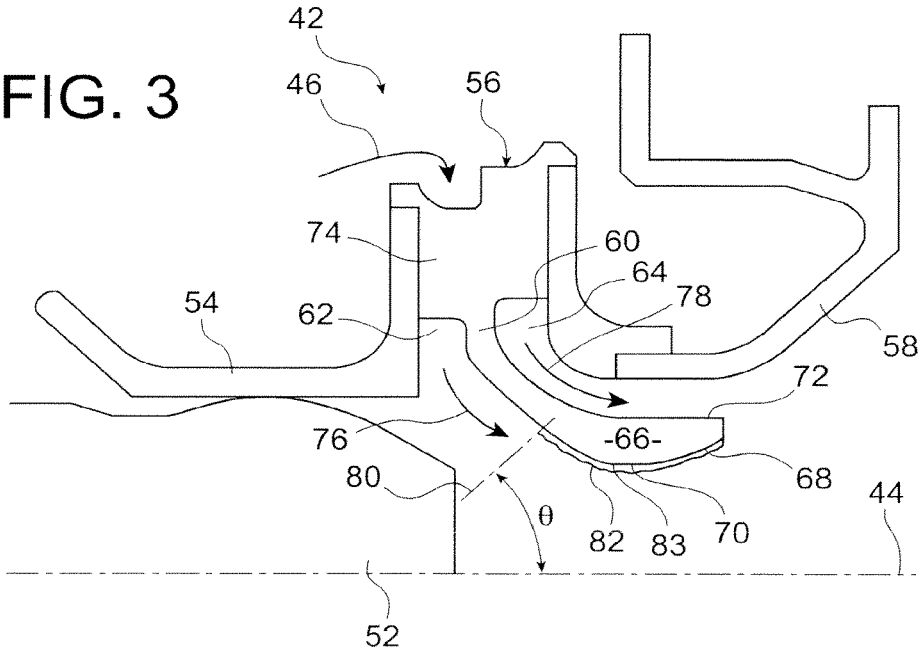
FIG. 3, previously described, is a partial diagrammatic half-view of an axial cross-section of an injection system with which the combustion chamber in FIG. 2 is equipped.
Figure 4:
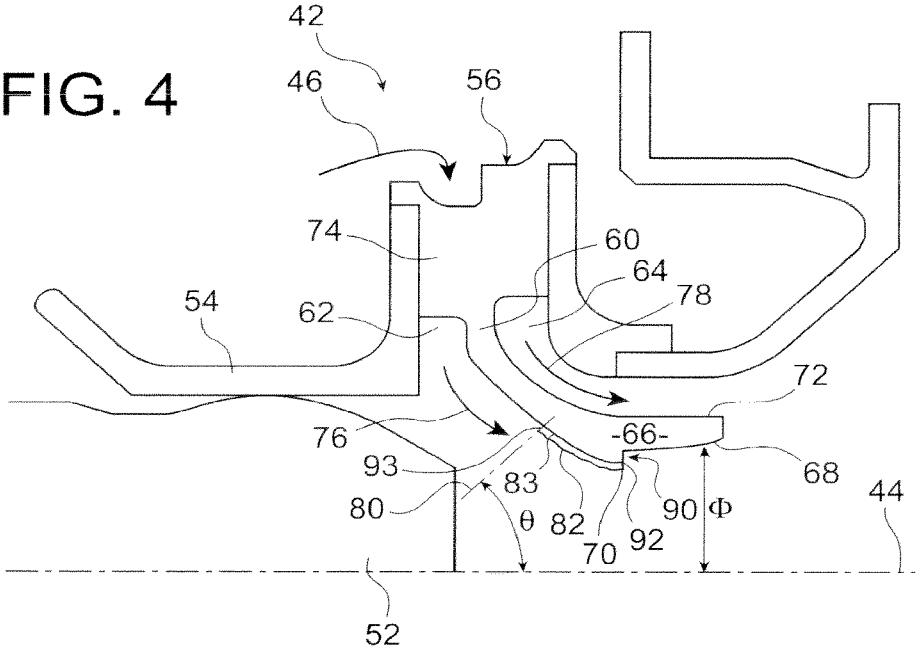
FIG. 4 is a view similar to that of FIG. 3, illustrating an injection system comprising an air intake ring according to one preferred embodiment of the invention.
Figure 5:
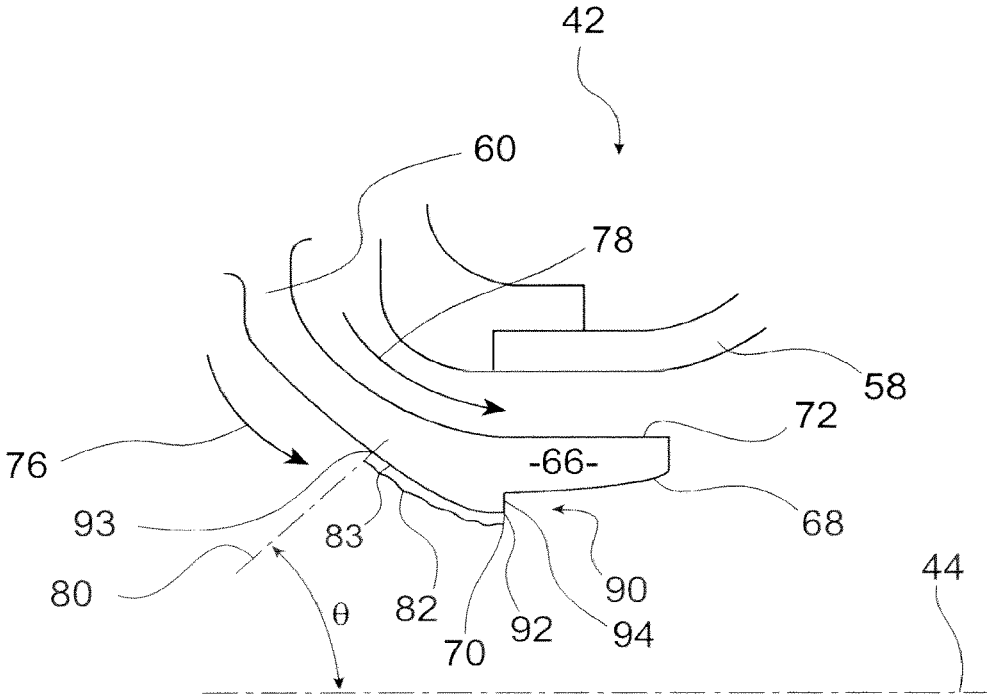
FIG. 5 is a more large-scale view of a portion of FIG. 4.

FIGS. 4 and 5 illustrate an injection system 42 that is similar on the whole to the injection system in FIGS. 1 to 3, however that is different in that it comprises an air intake ring 56 according to one preferred embodiment of the invention.

One feature of said air intake ring 56 is that the internal profile 68 of the annular deflection wall 66 is provided with a discontinuity 90 that induces an increase in the radius φ of the internal profile downstream of said discontinuity 90.

Therefore, a downstream portion of the internal profile 68 is set back, i.e. offset radially outwards relative to an upstream portion of said internal profile 68.

The discontinuity 90 induces the presence of an edge 92 at the level of the downstream end of the upstream portion of the internal profile.

Moreover, the discontinuity 90 is formed downstream of an upstream end 93 of the annular region 83 of the internal profile 68, over which trickles the fuel film 82.

During operation, the fuel forming the fuel film 82 trickling over the internal profile 68 tends to separate at the level of said edge 92, driven to such by the air flow 76 circulating along the internal profile 68.

The separation of the fuel into droplets, or atomisation, therefore takes place further upstream than with the known types of air intake ring. The droplets therefore have a larger volume for evaporation before penetrating the combustion chamber.

Moreover, the discontinuity 90 creates a recirculation area downstream thereof and induces turbulence, which favours the mixing of the fuel with the air, and which makes thickening the flame front possible In a general manner, the invention therefore improves the mixing of the air and fuel, and thus improves the combustion efficiency.

In one preferred example, as shown in FIG. 4, the discontinuity 90 is formed at the level of the neck 70 of the internal profile 68.

Therefore, the separation of the fuel into droplets occurs at the place at which the speed of the air flow 76 circulating along the internal profile 68 is the highest. This minimises the size of the fuel droplets generated.

Preferably, the discontinuity defines a shoulder 94 extending orthogonally to the axis of revolution 44 of the air intake ring 56 (FIG. 5).

For the purpose of illustration, the injection system 42 equips a combustion chamber similar to the combustion chamber in FIG. 2, within a turbomachine similar to the turbomachine in FIG. 1.

The injection system therefore allows for the implementation of a fuel atomisation method, wherein fuel originating from the injector head 52 trickles over the internal profile 68 of the annular deflection wall 66, and separates from said internal profile 68 at the level of the discontinuity 90 of the latter, so as to form droplets within the flow of air 76 coming from the upstream air circulation space 62 of the air intake ring 56 and circulating along the internal profile 68.

In a general manner, the invention allows for the reduction of the lean extinction proportions and CO/CH emissions.

The invention claimed is:

1. An injection system for a combustion chamber of a turbomachine, comprising:

a fuel injector head; and an air intake ring having an axis of revolution, the air intake ring comprising an annular separation wall that divides the air intake ring into an upstream air circulation space and a downstream air circulation space, wherein the annular separation wall extends radially inwards into an annular deflection wall having an internal profile with a convergent-divergent shape, wherein the internal profile of the annular deflection wall has a discontinuity of annular shape that presents a radial cut into the internal profile of the annular deflection wall so to induce an increase in a radius of the internal profile downstream of said discontinuity, wherein the fuel injector head is configured to spray fuel over an annular region of the internal profile of the annular deflection wall, and wherein said discontinuity is formed downstream of an upstream end of said annular region of the internal profile.

2. The injection system according to claim 1, wherein said discontinuity is formed at a level of a neck of the internal profile of the annular deflection wall.

3. The injection system according to claim 1, wherein said discontinuity defines a shoulder extending orthogonally to said axis of revolution of the air intake ring.

4. The injection system according to claim 1, wherein each of the upstream air circulation space and the downstream air circulation space re passed through by fins allowing for gyration of air about said axis of revolution of the air intake ring.

5. A combustion chamber for a turbomachine, comprising at least one injection system according to claim 1.

6. A turbomachine comprising at least one combustion chamber according to claim 5.

7. A method of atomizing fuel in the injection system according to claim 1, said injection system being associated with a turbomachine combustion chamber, wherein fuel originating from the fuel injector head trickles over the internal profile of the annular deflection wall, and separates from said internal profile at a level of the discontinuity of the internal profile, so as to form droplets within a flow of air coming from the upstream air circulation space of the air intake ring and circulating along the internal profile of the annular deflection wall.

* * * * *